United States Patent [19]

Schwarz

[11] 4,233,797

[45] Nov. 18, 1980

[54] AUTOMATIC BAGGING MACHINE

[76] Inventor: Karl E. Schwarz, 714 Tifft Ave., Horseheads, N.Y. 14845

[21] Appl. No.: 30,947

[22] Filed: Apr. 17, 1979

[51] Int. Cl.[3] ..... B65B 57/04; B65B 43/28

[52] U.S. Cl. ..... 53/66; 53/241; 53/373

[58] Field of Search ..... 53/66, 241, 256, 373

[56] References Cited

U.S. PATENT DOCUMENTS

| | | | |
|---|---|---|---|
| 3,340,678 | 9/1967 | Rhodes | 53/373 X |
| 3,895,480 | 7/1975 | Lombardo | 53/256 |

*Primary Examiner*—Travis S. McGehee

*Attorney, Agent, or Firm*—Shoemaker and Mattare, Ltd.

[57] ABSTRACT

A bagging machine which automatically encloses a garment in a bag. A continuous web of flexible material is fed into the machine, separated to form a tube, and that tube of material is pulled down over the garment. Material pulldown is stopped according to the length of the garment, the material is sealed, cut off from the web of material, then pulldown is completed to force a hanger through the top of the bag thus formed. In the preferred embodiment, pneumatic cylinders are used, and no electric motors are required. A hanger mechanism supports a garment in a manner which permits that garment to accommodate misalignment with respect to the machine, and the web separator is self-adjusting.

28 Claims, 11 Drawing Figures

FIG. 11.
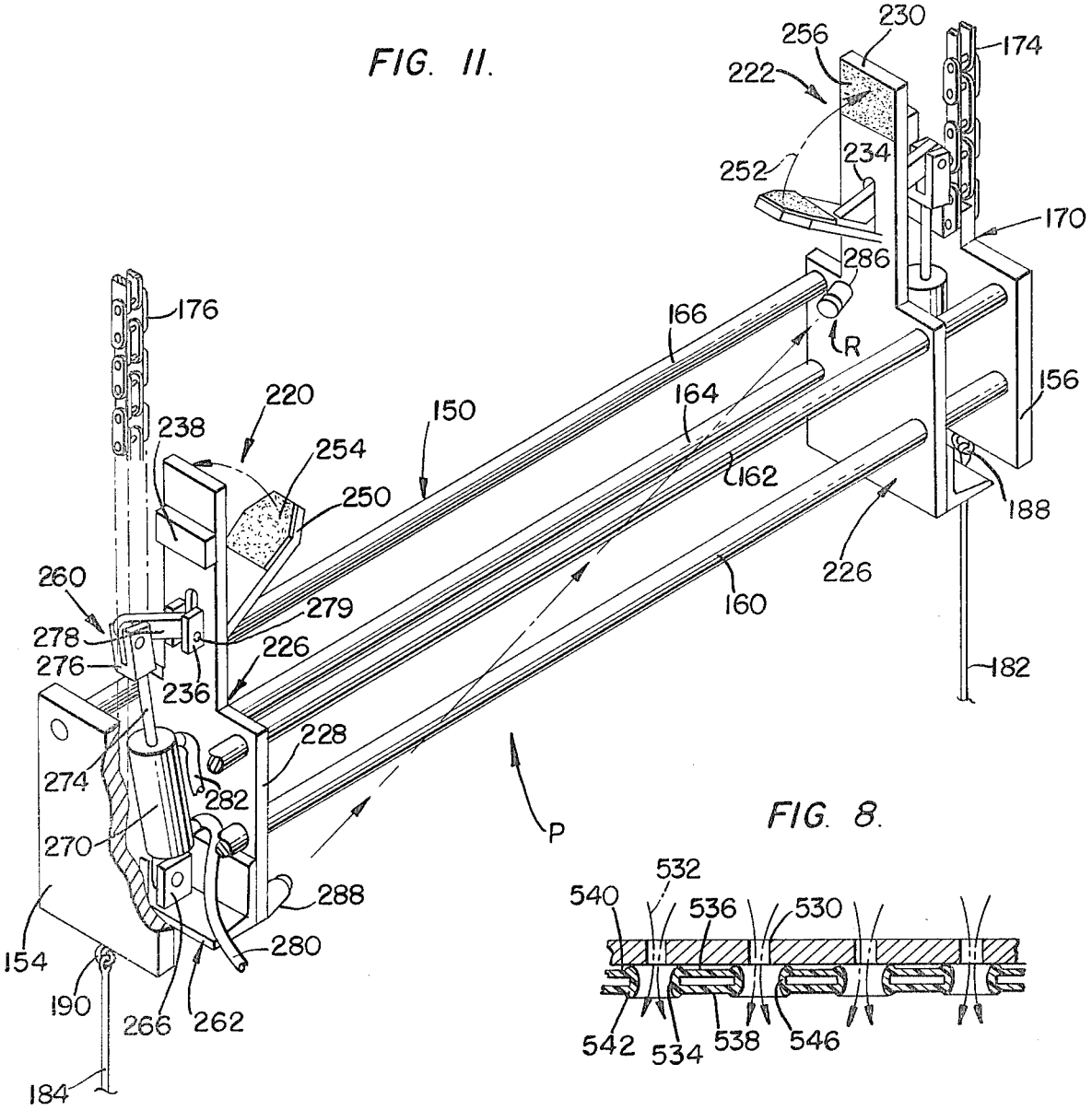
FIG. 8.
FIG. 7.
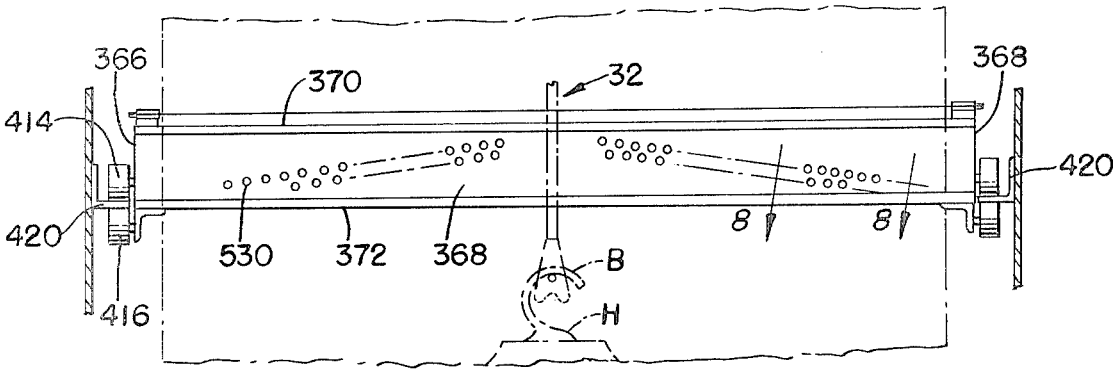

AUTOMATIC BAGGING MACHINE

BACKGROUND OF THE INVENTION

The present invention relates in general to bagging machines, and, more particularly, to automatic garment bagging machines.

In many industries, particularly in the manufacture of new garments, garments are enclosed in a bag of plastic-type material before being given to a customer.

The bags are generally formed from lengths of flexible material which is stored on a reel and withdrawn as required. The bag must be severed from the web of flexible material and sealed about the garment. Often such steps are partially, or wholly, performed by hand. Hand operations during a bagging step are time consuming and wasteful.

A further drawback to presently known devices is the inefficient manner in which the bags are sealed. The known devices use hot pins to melt the flexible material and thus weld the material layers together. Melting plastic using hot pins generates smoke and odors and produces carbon which builds up on the pins. The carbon and plastic thus eventually builds up on the pins to a level which makes those pins unusable. At this point, the pins must be cleaned or replaced which requires machine downtime and is thus expensive. Such pin cleaning and/or replacement is also costly in terms of labor, materials and the like. Therefore, a bagging machine which avoids the problems associated with hot pin bag sealing elements will represent an advance in the art.

Yet another drawback to presently known bagging machines is the high power consumption thereof. These machines often require 20 to 30 amps and 220 volts to operate. Such high power consumption is costly and wasteful. Thus, there is need for a bagging machine which has low power requirements (less than 10 amps at 110 volts).

Still another drawback to presently known bagging machines is the non-self-adjusting nature thereof. Thus, any misalignment of the garment with respect to the machine elements, or the machine elements with respect to each other, may create serious problems and even require shutdown of the machine, which, as above-discussed, is expensive.

Thus, there is need for a garment bagging machine which is fully automatic and which is efficient and reliable in operation.

SUMMARY OF THE INVENTION

The bagging machine embodying the teachings of the present disclosure is fully automatic. The machine bags garments on hangers of all types and automatically measures the garment, cuts a bag and seals that bag.

The machine is operated without the use of electric motors, and accordingly, efficiently and effectively performs the bagging operation.

The machine includes a carriage drive mechanism which has an actuating cylinder and means for converting the linear motion of an actuating cylinder rod to rotary motion. The rotary motion is converted into linear motion of a pulldown mechanism and is used by a spreader mechanism to pull flexible material into position. A sealer and cutoff mechanism is operated to seal the material and cut off a length of material from the web of material. A sequence control regulates operation so that the bag is finally positioned after the sealing operation.

The sealing operation is performed using hot, low pressure air forced from the heating chamber through a plurality of small holes against the flexible material to melt that material into small hole configurations. A very clean, strong seal is effected. No elements will become carbon covered, no smoke or odor will be generated, and overall savings in time and money will be produced.

Garment bag length is automatically set by the machine according to garment length. An infrared pulsating reflective scanner is focused diagonally of the pulling mechanism, and the garment itself actuates the scanner. When the garment ceases interrupting the light, the sequence control is actuated to initiate the stopping of the pulldown mechanism, and to initiate the sealing and cutoff mechanisms.

Material is spread and fed in a very precise manner by a spreader mechanism which includes a plurality of meshed gears. The spreader mechanism includes a plurality of resilient support rolls which permit the spreader to float so that a web is always efficiently spread without danger of damage thereto. Furthermore, this floating feature enables the spreader to be self-adjusting as to position. Thus, misalignment of a garment, or other machine elements, are accommodated by the floating spreader. In this manner, the spreader accommodates misalignments and does not require machine shutdown in all cases.

The machine also includes a garment hanger mechanism which is universally free. That is, any misalignment of the garment with respect to elements of the machine can be accommodated without requiring machine shutdown.

It is noted that the machine embodying the teachings of the present invention is operated without the use of electric motors. In the preferred embodiment, four air cylinders are used: one to drive the pulldown mechanism; one to operate the cutoff and sealing mechanism; and two small air cylinders used on gripping jaws of the pulldown mechanism. The use of pneumatic cylinders in place of electric motors permits the machine embodying the teachings of the present invention to operate on 110 volts and less than 10 amps, as compared to 20 to 30 amps at 220 volts for prior art mechanisms. The savings in power consumption related areas are evident from these figures. Thus, machine operation is efficient, reliable and exact, as well as being fully automatic.

OBJECTS OF THE INVENTION

It is, therefore, a main object of the present invention to provide a fully automatic garment bagging machine.

It is another object of the present invention to provide a garment bagging machine wherein very strong seals are effected on the flexible material used to enclose a garment.

It is a further object of the present invention to provide a garment bagging machine wherein garment length automatically sets the length of the bag.

It is yet another object of the present invention to provide a garment bagging machine wherein the web of flexible material used to form the garment bags is reliably and efficiently fed into the machine.

It is still another object of the present invention to provide a garment bagging machine wherein no electric motors are used.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 7 is a front elevation view of the hot air chamber used with the garment bagging machine embodying the teachings of the present invention.

FIG. 8 is a partial top plan view of the hot air chamber showing the flow of air used to seal a bag in a garment bagging machine embodying the teachings of the present invention.

FIG. 11 is a perspective view of the pulldown mechanism used with the bagging machine embodying the teachings of the present invention.

DETAILED DESCRIPTION OF THE INVENTION

Figure 1:
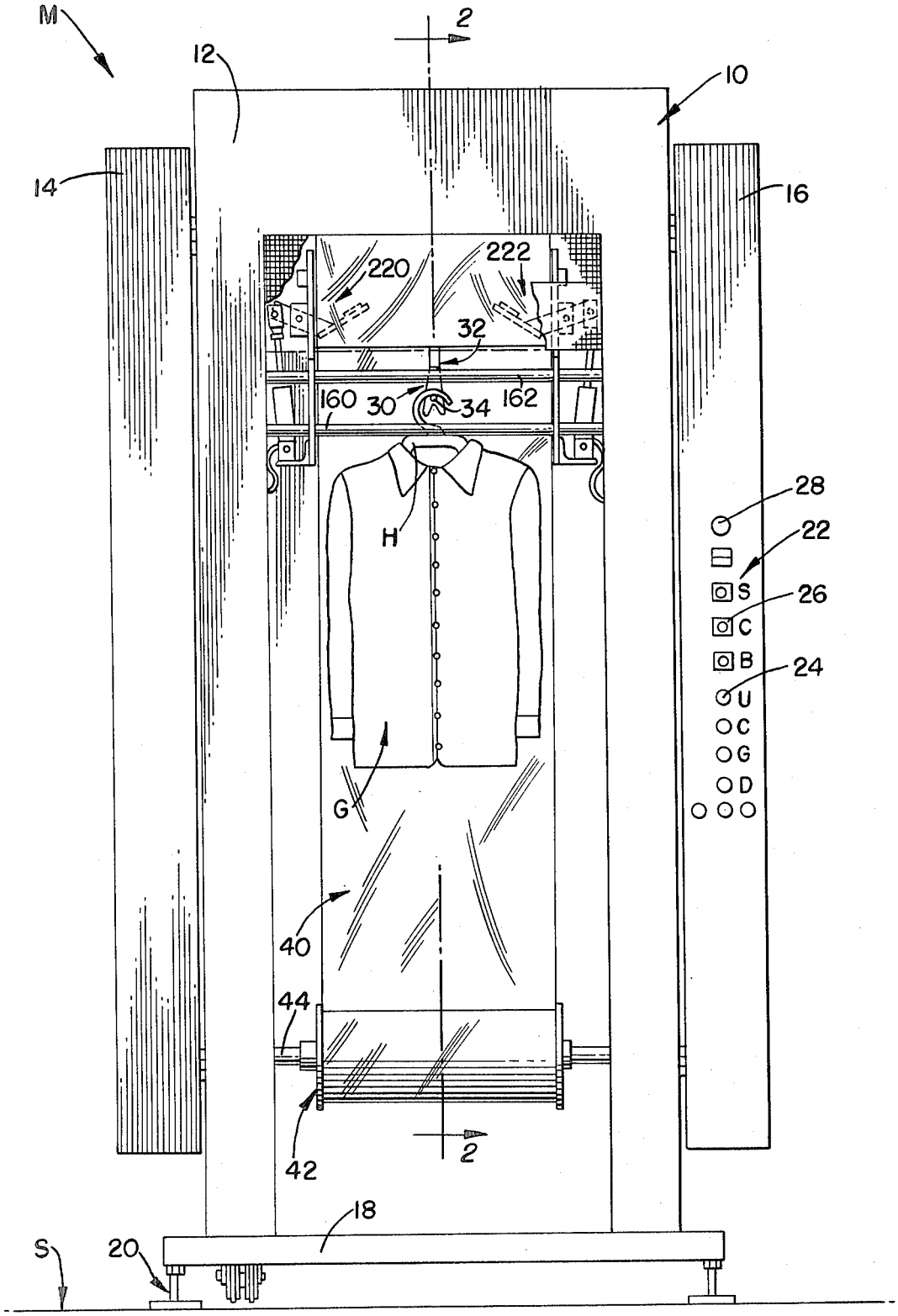
FIG. 1 is a front elevation of the garment bagging machine embodying the teachings of the present invention in a ready configuration.

Shown in FIG. 1 is an automatic garment bagging machine M. Machine M comprises a cabinet 10 which includes a front section 12 to which left and right side doors 14 and 16, respectively, are hingeably connected. The cabinet includes a base 18 which is supported on a support S by adjustable legs 20. A control panel 22 is mounted on the inside surface of right side door 16. The control panel includes a plurality of remote control buttons 24, switches 26 and light indicators 28 for controlling and regulating operation of the machine M.

Figure 5:
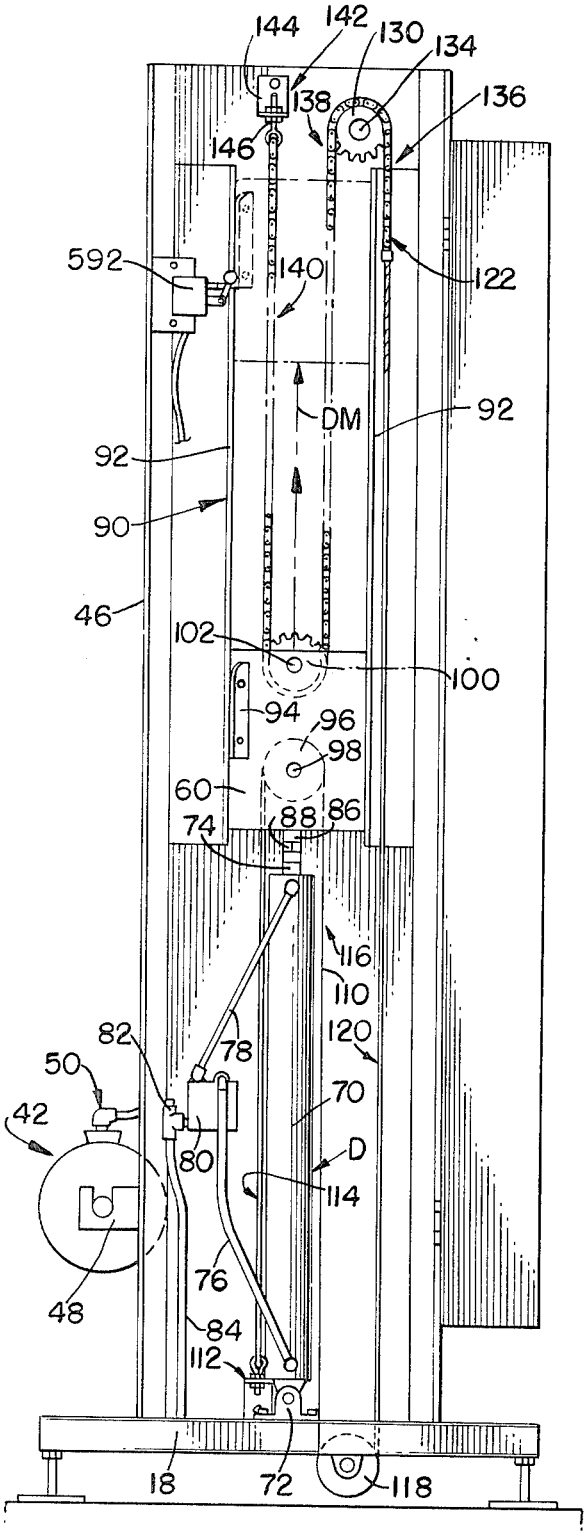
FIG. 5 is a side elevation of the garment bagging machine embodying the teachings of the present invention.

A garment to be bagged is shown in FIG. 1 as G and is supported by a hanger H on a garment hanger mechanism 30 which includes a depending arm unit 32 and a horizontally extending hook 34. The garment bags are formed from a tubular web of flexible material 40, such as polyethylene, or the like. As shown in FIG. 5, the web of material 40 is unwound from a supply spool 42 rotatably mounted on the machine cabinet 10 by a shaft 44. The spool 42 is mounted on the shaft in the usual manner for replacement, and the like, and the shaft is attached to the rear 46 of the machine cabinet 10 by a pair of mounting brackets 48 and includes a brake 50 for stopping the movement thereof. The material 40 is the usual garment bag type material which can be heat sealed and severed, as will be discussed below.

Figure 2:
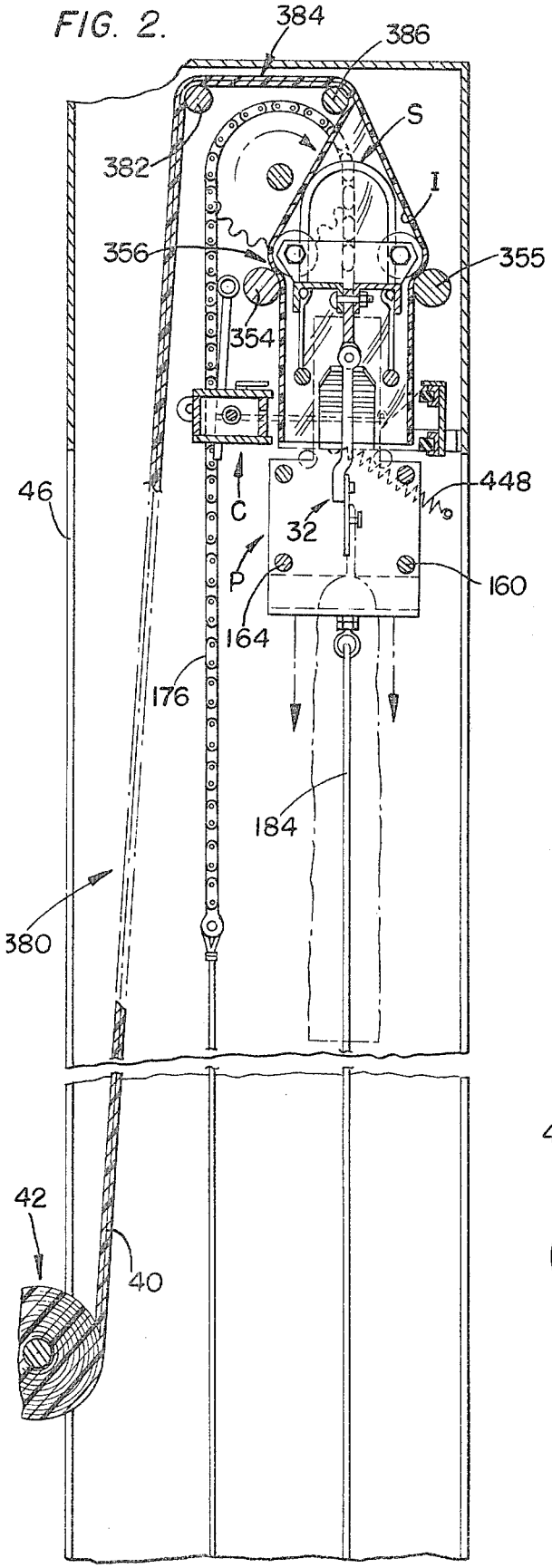
FIG. 2 is a side elevation of the garment bagging machine embodying the teachings of the present invention.
Figure 4:
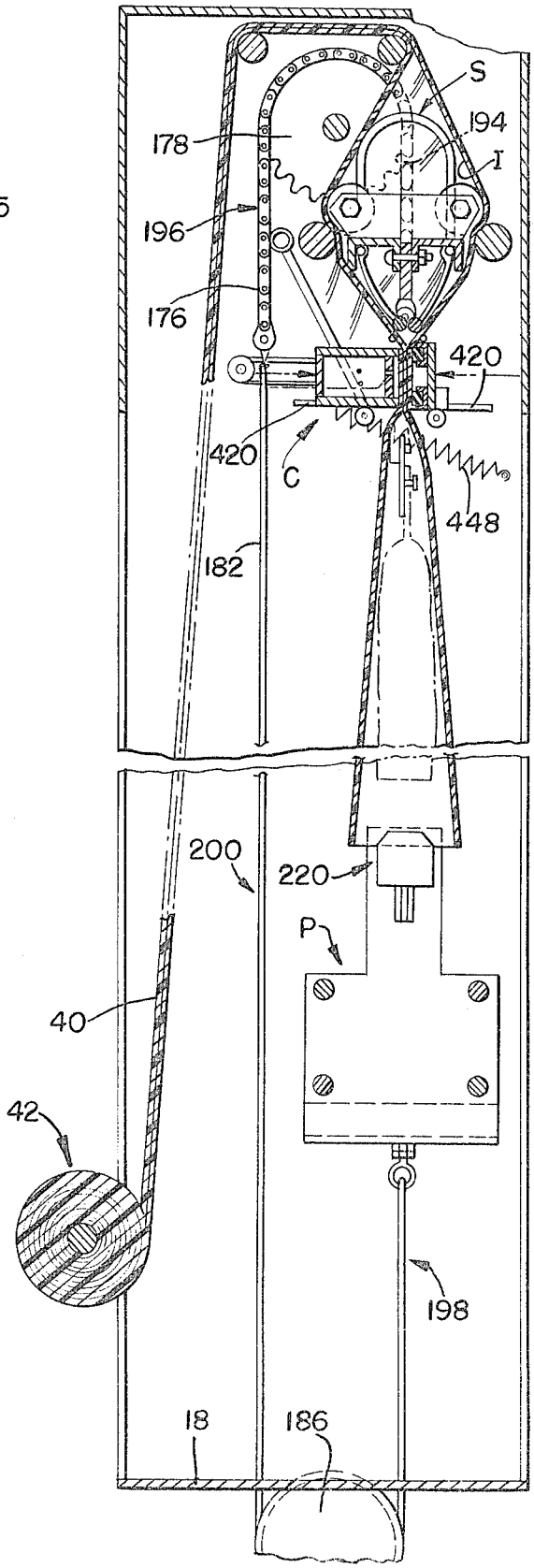
FIG. 4 is a side elevation of the garment bagging machine embodying the teachings of the present invention.
Figure 3:
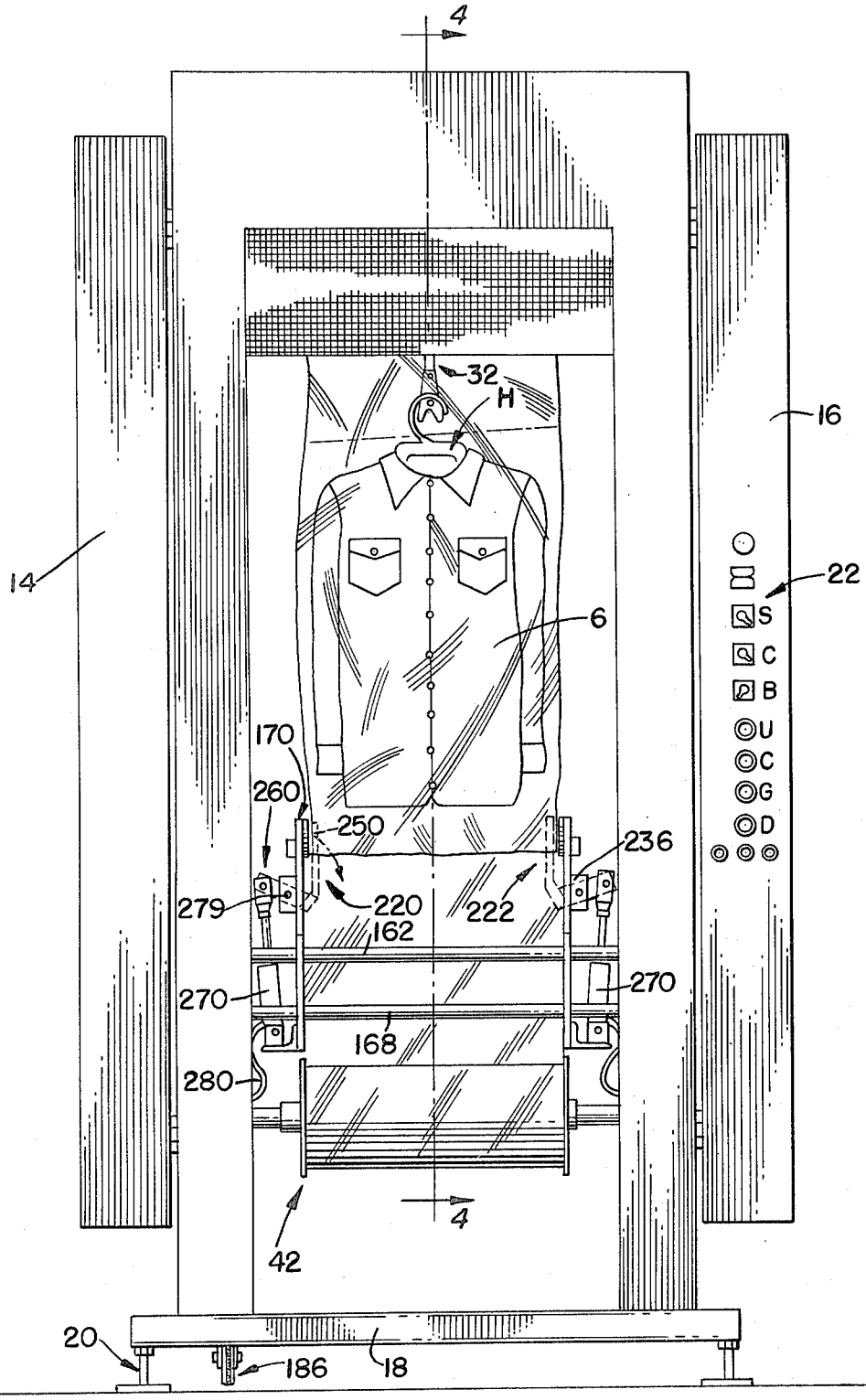
FIG. 3 is a front elevation of the garment bagging machine in a configuration after a garment is bagged and ready for removal.
Figure 9:
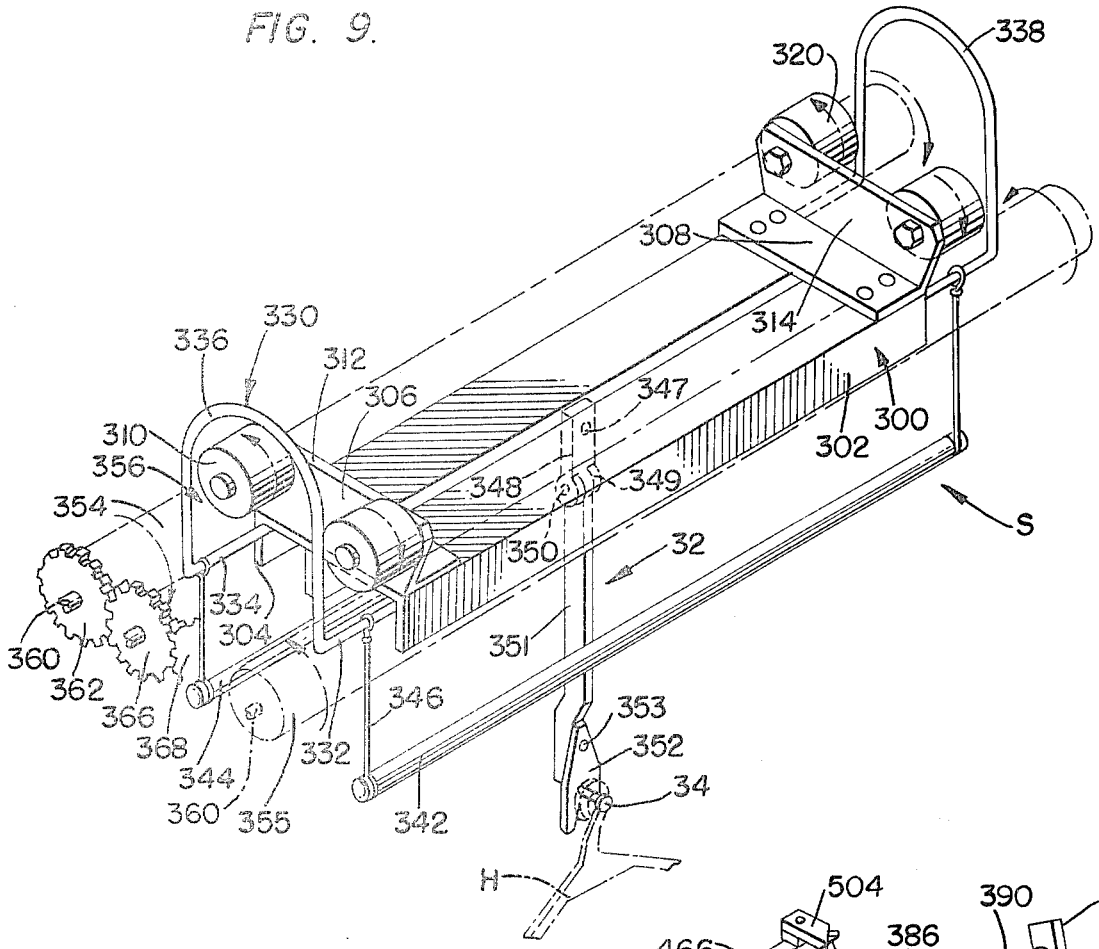
FIG. 9 is a perspective view of the spreader assembly used with the bagging machine embodying the teachings of the present invention.

The major subassemblies of the bagging machine are best shown in FIGS. 1–5, and attention is now directed to FIGS. 2–5. As shown in FIG. 5, the garment bagging operation is driven by a drive assembly D which is connected to a sliding drive block 60 slidably mounted within the cabinet 10. The slide drive block 60 is connected to a pulling assembly P best shown in FIGS. 11, 2 and 4. The pulling assembly P clamps a free edge of the web and pulls the web over and around a garment G during operation of the machine. A spreader assembly S, best shown in FIGS. 9, 2 and 4, is mounted within the cabinet 10 to spread the web into a bag forming tube as the pulling assembly P pulls the web around a garment as best indicated in FIGS. 2 and 4.

Figure 10:
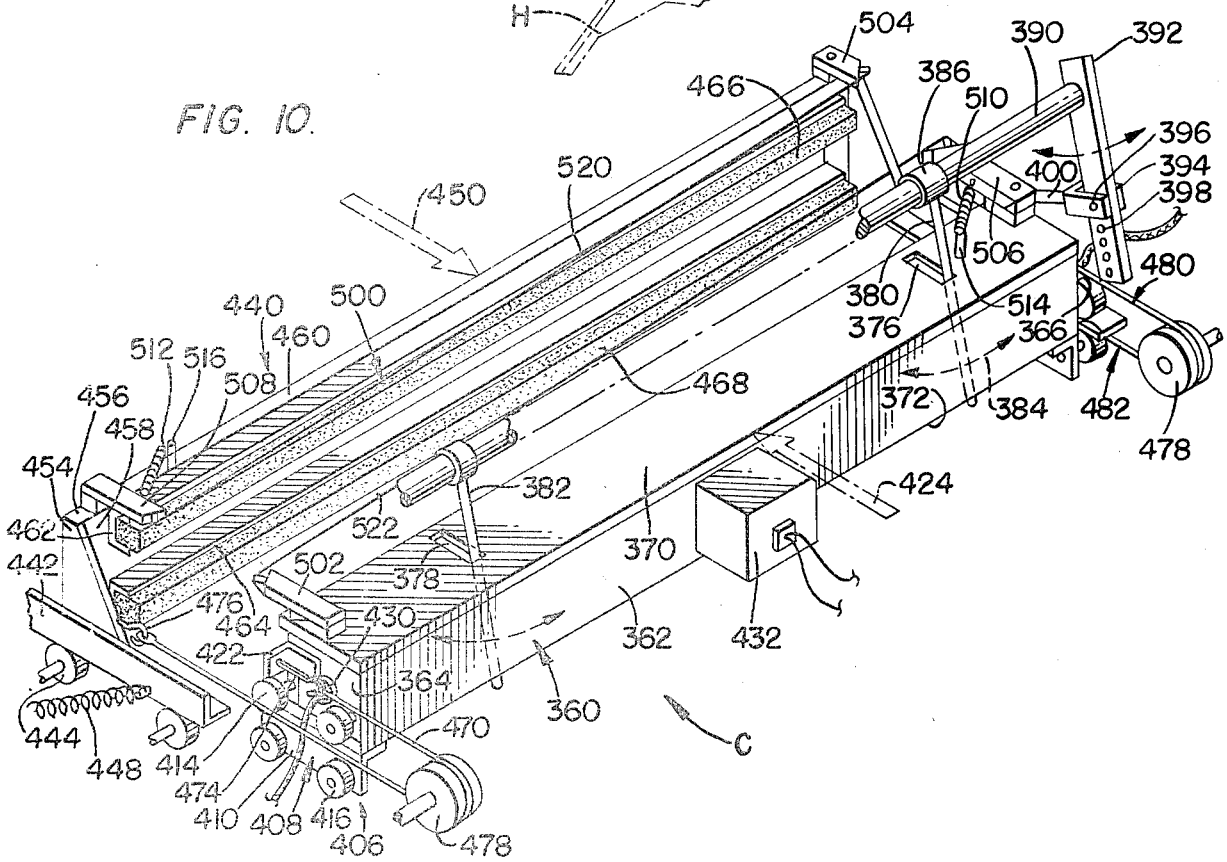
FIG. 10 is a perspective view of the sealing and cutoff assembly used with the bagging machine embodying the teachings of the present invention.

A sealing and cutoff assembly C is best shown in FIGS. 10, 2 and 4, and severs lengths of material from the web to form the garment bags which are used in this art. The sealing and cutoff assembly is mounted in the cabinet 10 above the garment hook 30 as shown in FIGS. 2 and 4. The sealing assembly is also shown in detail in FIGS. 7 and 8.

The drive assembly shown in FIGS. 2, 4 and 5 includes a carriage drive cylinder 70 pivotally mounted at a lower end thereof to the base 18 of the cabinet by a bracket 72. The cylinder extends upwardly from the bracket 72 and has an actuating rod 74 telescopingly received in the cylinder 70 and extending outwardly thereof at the top end of the cylinder. The cylinder is fluid operated by a fluid such as air, and fluid lines 76 and 78 are suitably attached at one end thereof to the cylinder and at the other end thereof to a fluid control valve 80. A fluid source line 84 is connected at one end thereof to the control valve 80 by a fitting 82 and at the other end thereof to a fluid supply and storage means (not shown in FIG. 5).

The actuating rod 74 is coupled to the drive block 60 by a stub shaft 86 and a coupling 88 and moves that block up and down in a guideway 90 defined by guide tracks 92 mounted on the inside of cabinet 10 and a switch trip block 94 mounted on the drive block 60.

A pulley 96 is rotatably mounted on the drive block 60 by a shaft 98 located near the lower end of that block. A sprocket 100 is rotatably mounted on the drive block 60 by a shaft 102 located near the upper end of that block.

A leader cable 110 is trained around pulley 96 and is attached to an anchor 112 located adjacent the lower end of the cylinder 70. The cable 110 is preferably aircraft cable or the like, and has a first ascending reach 114 from the anchor 112 to the pulley 96, a descending reach 116 from the pulley 96 to a guide pulley 118 mounted on the lower side of the base 18, and a second ascending reach 120 from the pulley 118. The cable is attached to one end of a drive chain 122 at the top of the second ascending reach 120.

The drive chain 122 is trained around a drive sprocket 130 which is mounted on a carriage drive shaft 134 which is rotatably mounted on the cabinet 10. The drive chain thus includes a first ascending reach 136 and a first descending reach 138 on opposite sides of the drive sprocket 130. The drive chain is trained around the sprocket 100 on the drive block 60 and has a second ascending reach 140 and is connected to an anchor 142 located near the top of the cabinet 10. The anchor 142 includes a bracket 144 and an eye-bolt 146 attached to the chain 122.

As the rod 74 is reciprocated by the drive cylinder 70, the drive block 60 reciprocates as indicated by arrows DM in FIG. 5 from the full line position to the phantom line position of the drive block shown in FIG. 5. As the drive block reciprocates, the drive chain reaches 138 and 140 shorten and the reach 136 lengthens a corresponding amount. This reach length change of the drive chain causes the drive sprocket 130 to rotate thereby rotating the carriage drive shaft 134. As will be discussed below, rotation of the drive shaft 134 moves the pulldown mechanism and the spreader assembly, thus operating the bagging machine M.

The pulldown assembly P is best shown in FIGS. 2, 4 and 11 and includes a cage 150 formed by rectangular outer carriage blocks 154 and 156 connected together by spanner bars 160, 162, 164 and 166 located near the corners of the blocks 154 and 156. The cage 150 extends across the cabinet 10 so that each of the blocks 154 and 156 is located on one side of the cabinet corresponding to the doors 14 and 16, respectively. Each carriage block includes a projection 170 to which carriage drive chains 174 and 176 are attached. As shown in FIGS. 2 and 4, the carriage drive chains extend upwardly from the carriage blocks and are trained around carriage drive sprockets, such as drive sprocket 178 shown in FIG. 4. The carriage drive sprockets are fixedly mounted on the carriage drive shaft 134 for rotation therewith.

The other ends of the carriage drive chains are each attached to one end of carriage control cables 182 and 184, respectively. The carriage control cables are trained around cable pulleys, such as pulley 186 shown in FIG. 4, to be located near the bottom of the cabinet beneath base 18. The other ends of the control cables are attached to the bottom of the carriage blocks 154 and 156 by hook bolts 188 and 190, respectively.

By referring to FIG. 4, operation of the pulldown carriage can be seen. As the drive shaft 134 is rotated by the drive chain 122, the carriage drive chains 174 and 176 are moved. Clockwise rotation of the drive shaft 134 in FIG. 4 lengthens descending reach 194 of the carriage drive chain 176 and shortens ascending reach 196 of that drive chain by a corresponding amount. Correspondingly, control cable 182 moves around the pulley 186 so that descending reach 198 shortens while ascending reach 200 thereof lengthens by a corresponding amount. The cage 150 thereby is moved downwardly from the FIG. 2 position to the FIG. 4 position. Counterclockwise movement of the drive shaft 134 reverses the just-described movement.

As shown in FIG. 11, the pulldown assembly P includes a pair of gripping jaws 220 and 222 each located adjacent a carriage plate. Each gripping jaw includes a mounting plate 226 having a rectangular base 228 through which the spanner bars extend so that the bases are attached to the carriage blocks. An ear 230 projects upwardly from each mounting plate and has an elongate slot 234 defined therein. Mounting blocks 236 are located adjacent the sides of the slot, and a transverse block 238 is located near the top of each ear. A swing arm 250 is swingably mounted on each projection beneath the slot to cover the slot as indicated by the arrows 252 in FIG. 11. A patch of friction material 254 is located on the swing arm for gripping the flexible web. A corresponding patch of friction material 256 is also located on each ear 230. A pair of swing arm actuating mechanisms 260 are mounted on the carriage and include channel racks 262 mounted on the mounting plates to provide bases upon which mounting brackets 266 are mounted. A pneumatic actuating cylinder 270 is swingably mounted on each mounting plate by the mounting brackets. The cylinders 270 include actuating rods 274 which reciprocate into and out of the cylinders. A yoke coupling 276 is attached to each actuating rod and is coupled to a connecting rod 278 which extends through the corresponding slot 234 to be connected to a swing arm 250. The connecting rods are pivotally attached to the mounting blocks 236 by pivot pins 279. The cylinders 270 are pneumatically actuated via lines 280 and 282, and movement of an actuating rod swings the attached swing arm 250 toward or away from the projecting ear via the pivotally mounted connecting rod. Actuation of the cylinders 270 causes the swing arms 250 to clamp the friction material 254 against a corresponding projecting ear 230 as indicated by arrows 252 in FIG. 11. It is noted that the linear motion of the carriage drive cylinder actuating arm 74 is converted into rotary movement of the various gears and sprockets so that the motion of the carriage drive cylinder actuating arm is converted into motion of the drive assembly in a two to one relation. Thus, a ten inch movement of actuating rod 74 results in a twenty inch movement of the pulling assembly.

As will be discussed below, the operating sequence of the bagging machine is controlled so that the gripping jaws 220 and 222 clinch the web of material 40 and pull that material down over a garment, then release that material so that a bagged garment can be removed from the cabinet 10.

An infrared pulsating reflective scanner R is mounted on the pulldown assembly to move therewith. The scanner R includes elements 286 and 288 mounted on the mounting plates 226 to be focused diagonally downward and rearward of the cabinet. That is, for example, as viewed from the front of the machine, from the upper right rear corner to the lower left front corner thereof. Other diagonal orientations can also be used, as long as the focus is diagonally transversely and longitudinally of the cabinet.

The scanner R senses the presence of a garment and produces a signal upon the absence of a garment. Thus, as the pulldown assembly pulls a web of material past the end of a garment, the scanner R generates a signal to be used in setting bag length. The pulldown step can be stopped at any time after the scanner signal is generated to set the length of the bag with respect to the garment length. An adjustable signal delay means can be associated with the scanner R to set the further length of material pulled after the garment bottom is sensed by the scanner. As will be discussed below, at the instant the pulldown assembly reaches the final pulldown location, the sealing mechanism is actuated to seal the web and the cutoff mechanism is actuated to cut off the bag. The diagonal focus of the scanner permits the scanner to be used with garments of unusual shape, such as nightgowns having an hourglass shape producted by a belt tied about the waist thereof.

The spreader assembly S is located near the top of the cabinet 10 and is best shown in FIG. 9. The spreader includes a support base 300 which is comprised of a pair of U-shaped channel brackets 302 and 304 coupled together by connector plates 306 and 308 to form a platform. A plurality of rolls 310 are rotatably mounted on a pair of mounting plates 312 and 314 to be horizontally disposed. The rolls 310 rotate in a horizontal plane as indicated by the arrows 320 in FIG. 9.

A spreader bar 330 is attached to the base 300 and includes a pair of horizontally disposed base bars 332 and 334 connected to the undersurface of the base 300 and located to be in spaced parallelism with each other. A pair of adjustable end guides 336 and 338 are each in the form of an inverted U and are integrally attached to opposite ends of the bars 332 and 334 to be in spaced parallelism with each other. The adjustable nature of the end guides allows adjustment for different widths of flexible material tubing. The spreader assembly is situated in the cabinet 10 so the planes containing the spreader end guides are transverse of the cabinet as shown in FIGS. 2 and 4.

A pair of adjustable spreader bars 342 and 344 are pendantly supported on the base bars 332 and 334 by support cables 346 attached at each end of each spreader bar. The cables 346 are preferably nylon.

The garment hanger mechanism 30 has the depending arm 32 attached at the upper end thereof to the adjacent side edges of the channel brackets 302 and 304 by a bolt 347 as best shown in FIG. 9 to hang downwardly from the spreader assembly. The hanger arm is attached to the channel brackets in a universal manner, and thus can be swung in any direction. The universal freedom of the hanger mechanism 30 permits the hanger to accommodate any garment orientation without endangering machine operation. The bolt 347 attaches a first, or top, bar 348 to the spreader base 300 to be pivotal in a first plane, that is a plane essentially perpendicular to the planes of the end guides 336 and 338. A yoke 349 is located on the lower end of the top bar and a yoke pin 350 pivotally connects the top end of a lower bar 351 to the lower end of the top bar 348. The lower bar is pivotal in a second plane which is essentially perpendicular to the first plane thereby defining a second degree of freedom to the hanger mechanism 30. The lower end of the lower bar 351 is offset and a hanger plate 352 is pivotally attached to the lower end of the lower bar 351 by a pivot pin 353. The hanger plate is thus pivotal in a plane essentially parallel to the first plane and adds a third degree of freedom to the hanger mechanism 30. The hook 34 is mounted on the hanger plate 352. A garment hanger H is supported on the hook 34 is indicated in FIG. 9. The multi-degrees of freedom of the hanger mechanism permits that mechanism to accommodate misalignment of the garment with respect to the elements of the bagging machine M.

Figure 6:
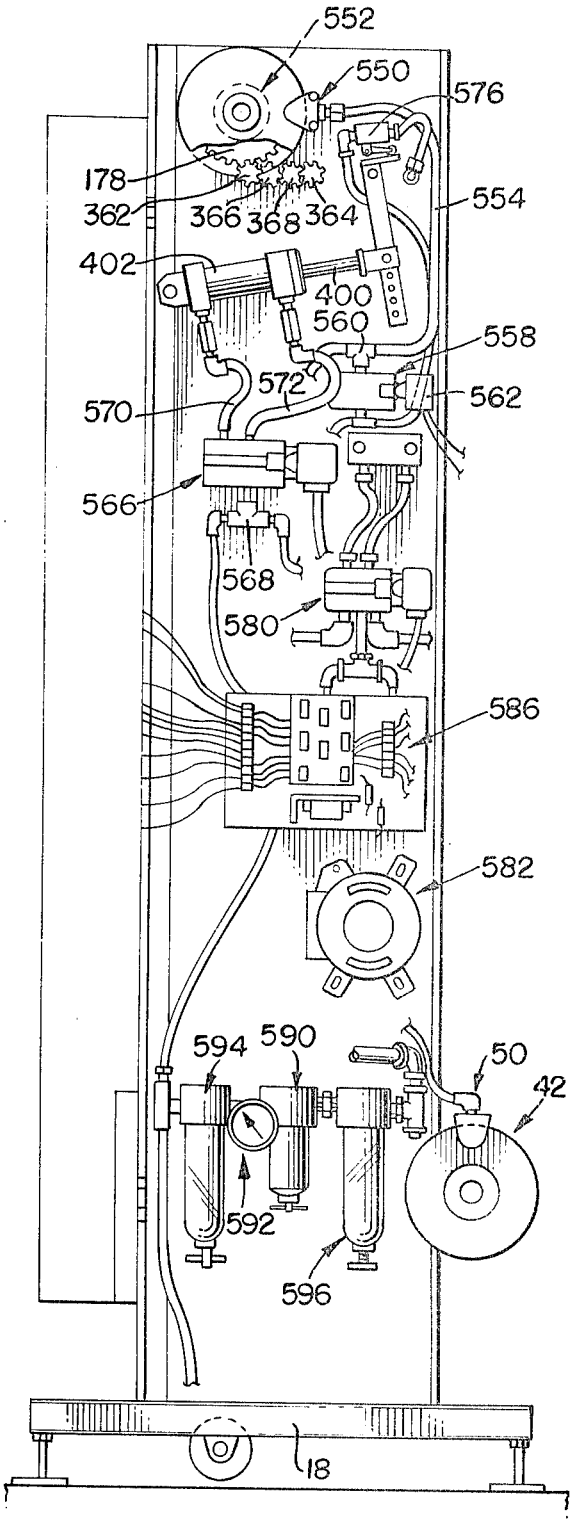
FIG. 6 is a side elevation of the garment bagging machine embodying the teachings of the present invention.

A pair of resilient spreader support rolls 354 and 355 are located to support the rolls 310 and to thereby form nipper gaps 356 through which the web of material 40 is received. The resilient nature of the rolls prevents damage to the flexible material. The support rolls 354 and 355 are pinned to shafts 360 for rotation therewith. The shafts 360 have drive gears 362 and 364 attached at one end thereof (see FIG. 6). The drive gear 362 is located adjacent drive sprocket 178 to be driven thereby. As best shown in FIG. 6, a plurality of intermediate sprockets 366 and 368 are intermeshed with each other and with the drive gears 362 and 364 so that rotation of the drive sprocket 178 drives the drive gears 362 and 364 in synchronism with each other thereby driving the support rolls 354 and 355 and rolls 310. The gears 362 through 368 are preferably Delrin gears and need not be lubricated. For a rotation of the drive sprocket 178 in a clockwise direction as viewed in FIG. 6, the support rolls 354 and 355 rotate as shown by the arrows 372 and 374 thereby pulling the web of material downwardly and inwardly as indicated in FIGS. 2 and 4.

It is noted that by having the rolls 310 rest on the support rolls 354 and 355 as shown in FIGS. 9, the spreader assembly can float from left to right and vice versa, and thereby automatically adjust itself to any orientation. The sealer is thus self-adjusting.

As is also shown in FIGS. 2 and 4, the web of material is fed upwardly in reach 380 over first guide roll 382, then horizontally in reach 384 over second guide roll 386, and then opened by the spreader mechanism S. The opened ends of the web are fed through nips 356 toward the pulldown assembly which has the gripping jaw projecting ears located in planes which are essentially parallel to the spreader end guides 336. As will be discussed below, the spreader bars 342 and 344 contact inner surface I of the web at selected times to force the web into a FIG. 2 spread configuration. The contact between the spreader bars and the web is best shown in FIGS. 2 and 4.

The cutoff and sealer assembly C is best shown in FIG. 10 and is mounted immediately subadjacent the spreader assembly S as shown in FIGS. 2 and 4. The cutoff and sealer assembly C includes a hot air chamber 360 defined by a plurality of walls 362, 364, 366 and 368 (see FIG. 7), as well as top wall 370 and bottom wall 372. A pair of elongate slots 376 and 378 are defined in the top wall 370, and a pair of return rods 380 and 382 are accommodated therein. The return rods are attached to the top wall 370 at the undersurface thereof, as by a flexible joint or the like (not shown), and undergo pivotal motion as indicated by the arrows 384 in FIG. 10. The return rods contact the end edges of the slots to move the chamber 360 forward and rearward, as will be discussed below. The lengths of the slots, if desired, can be used to define lost motion to produce a timing gap.

The return rods have rings 386 on the upper ends thereof and these rings encircle an oscillating rod 390 for movement therewith. The oscillating movement of the rod 390 therefore induces the pivotal motion of the rods for moving the cutoff and sealer assembly. The rod 390 is connected at one end thereof to a crank 392 which, in turn, is connected to a clevis 394 by a pivot pin 396. The pivot pin 396 is received in one of a plurality of holes 398 defined in one end of the crank 392. The motion of the oscillating rod 390 is determined according to which of the holes 398 receives the pivot pin connected crank. The clevis 392 is connected at one end of an actuating rod 400 of a pneumatic cylinder 402 (FIG. 6). Operation of the cylinder reciprocates the yoke which moves the crank and oscillates the rod 390 to move the hot air chamber.

The hot air chamber includes a chassis 406 which comprises an angle bracket 408 mounted on the bottom wall 372 and having a lower wall 410 depending downwardly from the bottom wall. A pair of upper guide rollers 414 are mounted on the end walls of the chamber 360 and a pair of lower guide rollers 416 are mounted on wall 410. The guide rollers contact appropriate guide tracks 420 (see also FIG. 4) to support and guide the hot air chamber 360. Thus, movement of the hot air chamber is in a direction indicated by the arrow 424 in FIG. 10 when the motion of the crank is toward the upper left of FIG. 10.

A heating element 430 is attached to the chamber to heat the air inside that chamber and a control box 432 is also mounted on the chamber. The heater 430 is preferably a 600 watt, 110 volt element. A temperature control switch can also be located within the control box 432. An airflow control valve can also be included in the control box.

A pressure plate assembly 440 is mounted to cooperate with the hot air chamber. The pressure plate assembly 440 includes a pair of mounting rails 442 resting on support rolls 444 (one pair on each end of the assembly 440) which are fixed by shafts 446 to cabinet 10 to support the pressure plate assembly. As shown in FIGS. 4 and 10, a return spring 448 is connected to the mounting rail 442 and to the inside of the cabinet 10. The spring 448 biases the pressure plate assembly in a direction opposite that shown by arrow 450 in FIG. 10 to return the pressure plate to a repose position.

The position plate assembly includes a pair of triangular end plates 454 mounted on the rails 442 to extend upwardly therefrom. A rear backing plate 456 is connected at each end thereof to one of the end plates and has an inner surface 458 and a top edge 460. The backing plate 456 is preferably aluminum.

A pair of U-shaped channel mounts 462 and 464 are mounted on the backing plate inner surface to be in spaced parallelism with each other and with the top edge 460. The channel mounts are mounted to open toward the hot air chamber, and pressure pads 466 and 468 are mounted within the channel mounts to extend outwardly thereof toward the hot air chamber as shown in FIG. 10. The pressure pads are preferably sponge rubber, or the like. Upon closing the cutoff and sealing assembly C, the pads 466 and 468 abut the chamber wall 368 capturing the flexible material therebetween.

The pressure plate and the hot air chamber are interconnected by a pair of cables 470 each of which has one end thereof connected to the hot air chamber by a bracket 472 and an eye-bolt 474, and the other end thereof connected to one end of the end plates by an eye-bolt 476. Each cable is trained around a fixed pulley 478. Movement of the hot air chamber in the direction of arrow 424 as induced by the oscillating rods lengthens top reach 480 of the cable thereby shortening the bottom reach 482 thereof. Such movement causes the pressure plate assembly to move toward the hot air chamber to form the aforementioned abutting contact between the pressure pads 466 and 468 and the hot air chamber wall 372 thereby capturing the material therebetween. Return movement of the pressure plate assembly is induced by the return spring 448, and such movement causes the cable 470 to move the hot air chamber away from the pressure plate assembly.

The assembly C includes a cutoff mechanism 500 comprising a pair of fixed mounts 502 and 504 mounted on the hot air chamber top wall 370 and the pressure plate top edge 460, respectively, to be on opposite ends of the assembly C. A pair of swivel mounts 506 and 508 are mounted on the ends of a hot air chamber top wall and pressure plate top edge which are opposite the fixed mounts. A pair of tension springs 510 and 512 are each connected at one end to the swivel mounts and at the other end to spring retaining posts 514 and 516. The electrically resistive heating wires 520 and 522 are mounted on the mounts to sway it diagonally from left to right of the assembly C as seen and indicated in FIG. 10. The slanting nature of the wires 520 and 522 produces a knife cutoff of the flexible material. Potential is applied across the wires at the mounts to heat those wires. The heated wires effect the cutoff of a bag as will be discussed below, and the springs 510 and 512 can be used to adjust the position of the wires.

A fan is located internally of the hot air chamber and is controlled via control box 432. The fan forces air across the heating element 430 to be heated thereby. As shown in FIG. 7, a plurality of air holes 530 are defined in the chamber front wall 368. As shown in FIG. 8, the hot air flows through these holes outwardly of the chamber in a direction indicated by arrows 532 in FIG. 8. The flexible material is trapped in front of the holes by the pressure pads 466 and 468, and thus spot welds are formed at the location of the air holes. The spot welds weld the garment bag together at one end thereof.

As shown in FIG. 8, the hot, low pressure air forced through holes 530 against the flexible material melts that flexible material in small hole configurations 534. Since there are two layers of flexible material 536 and 538, the peripheral edges 540 and 542 of the holes 534 melt together to form a bond 546 between the two layers thereby forming a very strong seal. As above-discussed, using heated air to effect the bag seal is clean, low cost and effective, especially as compared to the means used by prior art devices.

The operation of the cutoff and sealing assembly C is sequenced to effect sealing and cutoff when the flexible material has been pulled down to a predetermined position with respect to a garment. The lost motion feature produced by the slots 376 and 378 can, if desired, provide a sequencing step to permit the sealed bag to be forced over the hanger H, as the sealing occurs above the hanger as indicated in FIG. 4. Thus, at a lower position of the pulldown assembly, the sealing assembly is actuated to seal the web together and the cutoff assembly is actuted to cut off a length of material from the web to thereby form a bag. The pulldown mechanism then continues the pulldown portion of the sequence in a second pulldown step, and the sealed bag is pulled down over the hanger. As indicated in FIG. 7, the air holes 530 are arranged so the material is not sealed in the area of the hook B of the hanger H thereby facilitating the aforementioned operation.

Referring to FIG. 6, it is seen that the drive sprocket 178 has a brake 550 and a clutch 552 associated therewith. The clutch 552 is a one-way clutch which disengages the drive sprocket 178 from the drive shaft 134 during return movement of the pulldown assembly so that the flexible material is not "unwound" from the loaded position shown in FIG. 2 during the movement of the pulldown assembly from the FIG. 4 position back to the FIG. 2 position. The brake 550 is fluid operated by a fluid system, such as air or the like. The fluid system includes an air hose 554 connected at one end thereof to the brake means 550 and at the other end thereof to a control valve 558 via a coupling 560. A control unit 562 controls operation of the valve 558. The valve 558 controls operation of the brake 550. The sealer drive cylinder 402 is fluid operated and a fluid control valve 566 is mounted on the cabinet 10. The fluid from a source is conducted to the valve 566 via a coupling 568, and to the cylinder 402 via lines 570 and 572. A sealer shutoff control valve 576 is mounted on the cabinet 10 to be controlled according to movement of the crank 392 and, hence, the oscillating rod 390.

The pulldown assembly is controlled by a control valve mechanism 580, and the cutoff wire voltage is controlled by control mechanism 582.

Overall sequence of operation is controlled by control regulator 586 which includes circuit elements, timing mechanisms and the like usual to circuit control means. The elements of the regulator 586 required to effect electronic control of the mechanical elements of the machine M will be known to those skilled in the art from the discussion presented herein, and thus no detailed description of these elements will be presented.

As shown in FIG. 6, the machine M also includes an air supply 590, a regulator 592, an oiler 594 and a filter 596 mounted thereon. These elements are connected with each other and with appropriate ones of the above-discussed elements as will be apparent to those skilled in the art from reading the present disclosure.

The sequence of operation is apparent from the foregoing, and will be described briefly with reference to FIGS. 1–5. A garment G is loaded either by hand or automatically, as desired, into the cabinet in FIG. 1 and hung from hanger H in the usual manner. The pulldown assembly P is in the topmost position in FIG. 1. Appropriate buttons and controls from panel 22 are operated, and the sequence of operation is initiated. The drive cylinder 70 is actuated to move the carriage drive block 60, thereby rotating the carriage drive sprocket 130 and the carriage drive shaft 134. Rotation of the drive shaft 134 causes rotation of the drive sprocket 178, which causes rotation of the meshed pinions 362–368. Rotation of the meshed pinions 362–368 rotates support rolls 354 and 355 which feeds material 40 from the supply spool 42. The spreader end guides cause separation of the web sides into the tube configuration of FIG. 2.

The gripping jaws 220 and 222 are actuated to grasp the edges of the tube and form an open end of the tube. The gripping jaws clasp the tube so the puller assembly can pull that tube downwardly into the position shown in FIG. 3. Rotation of the drive sprocket 178 causes the pulldown assembly P to move from the FIG. 2 position toward the FIG. 4 position.

When the scanner R senses the bottom end of a garment, a signal is generated, and the sequence controller 586 causes the sealing assembly C to be actuated when the pulldown assembly is in a predetermined position with respect to the garment, such as, for example, a few inches below that garment bottom, or the like. The sealer assembly cylinder 402 is actuated to oscillate the rod 390 and force the hot air chamber and the pressure plate assemblies together as shown in FIG. 4. The cutoff assembly is also actuated to cut the sealed section of tube from the remainder of the web.

As is also shown in FIG. 4, the sealing occurs above the hanger. Hence, the operation is completed by pulling the sealed bag down over the hanger. Thus, the pulldown assembly completes the cycle thereof in four steps: pulldown, pause, second travel (or second pulldown), then return to the FIG. 2 position. The timing of the pause step can be set in the regulator 586, or by gearing, or by the aforediscussed lost motion sequencing. The timing sequence of the controller is initiated and keyed by the scanner mechanism R shown in FIGS. 2 and 4.

After completion of the just-described pulldown step, inward travel of the sealing and cutoff assembly mechanisms is initiated. The sealer seals the flexible material by forcing hot air which has been pre-heated above the melting point of the flexible material through holes 530 and through the material. It has been noted that cutoff of the bag from the length of material occurs above the hanger, a preset second down-travel movement of the puller mechanism takes place after the sealing assemblies have been moved apart. After the sealing step, the hot air chamber and the pressure plate are moved apart, and the spreader bars 342 and 344 help force the web apart into the tubular configuration shown in FIG. 2 which will be used for forming the next garment bag. An up-button is pushed after removal of a bagged garment, and the above-discussed steps are repeated for the next garment.

After the final pulldown step, bagging of the garment is completed, and the pulldown assembly is returned to the FIG. 2 position. The bagged garment can then be removed from the machine by hand, or automatically, as desired. As aforediscussed, a one-way clutch, or the like, is used to permit the drive sprocket 178 to move in the retrograde direction while keeping the flexible material positioned and ready for another bagging sequence. The brake 50 can also be used to control movement of the flexible material off of the supply spool, and the brake 550 can be used to control movement of the drive sprocket 178.

A safety switch 592 can be included to prevent overrun by the carriage drive block, and other safety mechanisms can also be included to prevent undesirable operation of the machine M. By proper setting of the scanner mechanism R, the sequence controller 586, selection of sprockets and the like, any length of bag or proportions thereof can be selected. The flexible material is preferably a plastic-type of material such as polyethylene, or the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A garment bagging machine comprising:

a cabinet;

material guide means on said cabinet for guiding tubular bag forming material from a bag forming material supply means;

spreader means on said cabinet for spreading the walls of said tubular material apart;

hanger means on said spreader for supporting a garment to be bagged;

pulldown means movably mounted on said cabinet and having material gripping means thereon for gripping the bag forming material so that such bag forming material can be pulled down over a garment supported on said hanger means;

gripping means power means on said pulldown means, and gripping jaw connecting means connecting said gripping means power means to said gripping means;

garment length sensing means on said pulldown means;

bag sealing means mounted on said cabinet for sealing the walls of the tubular bag forming material together, said sealing means including a hot air generating means which generates air hot enough to melt the bag forming material, hot air directing means on said hot air generating means for directing hot air onto the bag forming material to be sealed, and clamping means on said bag sealing means for clamping the walls of the bag forming material together adjacent said hot air directing means so that hot air issuing from said hot air directing means contacts the clamped together walls of the bag forming material whereby such hot air melts the bag forming material so that such clamped together walls are fused together thereby forming a seal on a bag;

bag cutoff means on said bag sealing means for cutting off a length of material from the bag forming material guided from the supply means;

main drive power means for moving said pulldown means, said main drive power means including a drive pneumatic cylinder;

said pneumatic cylinder including an actuating rod and connecting means connecting said pneumatic cylinder actuating rod to said drive means with said connecting means including a drive block slidably mounted on said cabinet and connected to said actuating rod to be reciprocated thereby, a pulley mounted on said drive block, a sprocket mounted on said drive block, a first rotatable drive sprocket mounted on said cabinet, a cable means trained around said pulley and connected at the end thereof to said cabinet, said cable means translating the linear reciprocating movement of said drive block into rotational movement of said first drive sprocket so that as said drive block reciprocates in response to reciprocating movement of said drive pneumatic cylinder actuating rod, said first drive sprocket rotates, a second drive sprocket connected to said first drive sprocket for rotation therewith, a pulldown means chain means trained around said second drive sprocket to be moved thereby and connected at the ends thereof to said pulldown means for causing linear reciprocating movement of said pulldown means in response to rotation of said second drive sprocket; and control means for controlling operation of said main drive power means.

2. The garment bagging machine defined in claim 1 wherein said cable means includes a cable trained around said pulley and connected at one end thereto to said cabinet and a chain trained around said sprocket and said first drive sprocket and connected at one end thereof to another end of said cable and at the other end thereof to said cabinet, and said pulldown means includes a pulldown means pulley mounted on said cabinet and a pulldown means cable trained around said pulldown pulley and connected at one end thereof to said pulldown means and at another end thereof to another end of said pulldown chain.

3. The garment bagging machine defined in claim 1 wherein said gripping means further includes gripping jaws for gripping bag forming material.

4. The garment bagging machine defined in claim 3 wherein said gripping means power means consist of pneumatic cylinders.

5. The garment bagging machine defined in claim 4 wherein said garment length sensing means includes control means for sensing the bottom of a garment and generating a signal in response thereto.

6. The garment bagging machine defined in claim 5 wherein said control means includes an infrared pulsating reflective scanner located on said pulldown means to be focused across said cabinet in a direction which is diagonal of said cabinet in both a transverse and longitudinal direction of said cabinet.

7. The garment bagging machine defined in claim 1 wherein said spreader means includes a plurality of spreader drive sprockets connected to said second drive sprocket to be rotated therewith, a pair of support shafts each connected to one of said spreader drive sprockets for rotation therewith, a resilient spreader support roll mounted on each support shaft for rotation therewith, a plurality of mounting rolls mounted on said support rolls to be rotated thereby, the points of contact between said support and mounting rolls forming nipper points for grasping the bag forming material to move that material as said support rolls are rotated by the rotation of said spreader drive sprockets, a spreader mounting base on which said mounting rolls are mounted.

8. The garment bagging machine defined in claim 1 wherein said hanger means includes a universal joint so that said hanger can move with respect to said spreader.

9. The garment bagging machine defined in claim 7 wherein said spreader further includes a plurality of adjustable end guides mounted on said spreader base.

10. The garment bagging machine defined in claim 9 wherein said spreader further includes a plurality of spreader bars movably attached to said end guides.

11. The garment bagging machine defined in claim 1 wherein said bag sealing clamping means includes a pressure plate assembly movably mounted on said cabinet, a hot air chamber defining means movably mounted on said cabinet, and clamping moving means for moving said pressure plate assembly and said hot air chamber defining means together.

12. The garment bagging machine defined in claim 11 wherein said clamping moving means includes a power means mounted on said cabinet, a crank attached to said power means to be rotated thereby, an oscillating rod attached to said crank to be rotated thereby, a plurality of operating rods each attached at one end thereof to said oscillating rod to be pivoted thereby, rod contacting means on said hot air chamber defining means contacting said operating rods so that pivotal movement of said operating rods moves said hot air chamber defining means, a clamping means pulley mounted on said cabinet, a cable attached at one end thereof to said hot air chamber defining means and at another end thereof to said pressure plate assembly, said cable being trained around said clamping means pulley so that movement of said hot chamber defining means causes corresponding movement of said pressure plate assembly.

13. The garment bagging machine defined in claim 12 wherein said clamping means power means consists of a pneumatic cylinder.

14. The garment bagging machine defined in claim 12 or 13 wherein said pressure plate assembly includes a plurality of resilient pressure pads.

15. The garment bagging machine defined in claim 12 wherein said clamping moving means further includes a return spring connected at one end thereof to said cabinet and at another end thereof to said pressure plate assembly for separating said pressure plate assembly and said hot air chamber defining means.

16. The garment bagging machine defined in claim 1 wherein said bag cutoff means includes a pair of heated wires with one wire being mounted on said hot air chamber defining means and the other wire being mounted on said pressure plate assembly.

17. The garment bagging machine defined in claim 16 wherein said wires are slanted with respect to said sealing means to produce a clean cutoff.

18. The garment bagging machine defined in claim 1 further including a brake on said second drive sprocket.

19. The garment bagging machine defined in claim 18 further including a one-way clutch on said second drive sprocket to disconnect said second drive sprocket from said spreader means during a return movement of said pulldown means so that bag forming material movement is only into said machine.

20. The garment bagging machine defined in claim 1 wherein the bag forming material is plastics-type material and is stored on a storage reel.

21. The garment bagging machine defined in claim 20 further including a reel brake on said storage reel.

22. The garment bagging machine defined in claim 1 further including a control means on said machine and connected to said garment length sensing means for controling said main drive power means in response to garment length.

23. The garment bagging machine defined in claim 8 wherein said hanger includes a top bar pivotally attached to said spreader means base to pivot in a first plane, a lower bar pivotally connected to said top bar to pivot in a second plane, a connecting plate pivotally attached to said lower bar to pivot in a third plane, and a connecting hook to which a garment hanger can be connected.

24. The garment bagging machine defined in claim 1 wherein said hot air generating means includes an electrical resistance heating element and a fan.

25. The garment bagging machine defined in claim 16 wherein said heated wires are adjustably mounted on said bag sealing means.

26. The garment bagging machine defined in claim 1 wherein said cabinet includes doors.

27. The garment bagging machine defined in claim 1 wherein said gripping jaw connecting means includes a crank.

28. The garment bagging machine defined in claim 1 wherein said pulldown means includes a plurality of spanner bars.

* * * * *